US007498751B2

(12) United States Patent
Bai et al.

(10) Patent No.: US 7,498,751 B2
(45) Date of Patent: Mar. 3, 2009

(54) HIGH EFFICIENCY AND LOW COST COLD CATHODE FLUORESCENT LAMP DRIVING APPARATUS FOR LCD BACKLIGHT

(75) Inventors: Shwang-Shi Bai, Tainan (TW); Yu-Pei Huang, Tainan (TW); Shen-Yao Liang, Tainan (TW); Shu-Ming Chang, Tainan (TW)

(73) Assignee: Himax Technologies Limited (TW)

( * ) Notice: Subject to any disclaimer, the term of this patent is extended or adjusted under 35 U.S.C. 154(b) by 259 days.

(21) Appl. No.: 11/424,468

(22) Filed: Jun. 15, 2006

(65) Prior Publication Data

US 2007/0290624 A1 Dec. 20, 2007

(51) Int. Cl.
*H05B 41/16* (2006.01)

(52) U.S. Cl. ..... 315/247; 315/209 R; 315/276; 315/291; 315/307

(58) Field of Classification Search ..... 315/247, 315/246, 209 R, 276, 274, 278, 291, 307
See application file for complete search history.

(56) References Cited

U.S. PATENT DOCUMENTS

| | | | | |
|---|---|---|---|---|
| 4,607,323 | A | 8/1986 | Sokal et al. | |
| 5,818,709 | A | 10/1998 | Takehara | |
| 5,834,907 | A | 11/1998 | Takehara | |
| 2002/0180380 | A1 * | 12/2002 | Lin | 315/224 |
| 2006/0038513 | A1 * | 2/2006 | Henry | 315/291 |

* cited by examiner

*Primary Examiner*—Tuyet Vo
(74) *Attorney, Agent, or Firm*—Baker & McKenzie LLP

(57) ABSTRACT

The invention is a driving apparatus and circuit for efficiently converting a direct current (DC) signal into an alternating current (AC) signal to drive a fluorescent lamp. A semi class E configuration which utilizes only one transistor is employed in the invention. The invention comprises a power transistor, a transformer wherein a primary winding is used as a load for the power transistor and a secondary winding is used to transfer energy to the load for the driving apparatus, i.e. the CCFL tube, and control means which extracts the frequency and current of the power transistor and corrects the deviation between the frequency of the power transistor and that of the control means.

19 Claims, 4 Drawing Sheets

HIGH EFFICIENCY AND LOW COST COLD CATHODE FLUORESCENT LAMP DRIVING APPARATUS FOR LCD BACKLIGHT

FIELD OF THE INVENTION

This invention relates to the field of discharging a light device and, in particular, to efficiently supply a power source to drive fluorescent lamps, i.e. the backlight of a liquid crystal display (LCD) panel, by an alternating current signal with a direct current power source, i.e. a battery of a notebook or an LCD monitor of a desktop computer.

BACKGROUND OF THE INVENTION

The cold cathode fluorescent lamp (CCFL) was developed in the late twentieth century and is currently used in many products such as the backlight source for flat panel display. The CCFL, different from a filament lamp, is a discharge lamp composed of a low-pressure mercury emitting 253.7 mm ultraviolet light. The ultraviolet light is emitted from mercury molecules impacted by the discharged electrons, thereby generating more electrons bombarding the fluorescent materials coated inside the tube. The CCFL is characterized by its longer lifetime and lower operating temperature than that of a filament lamp. Thus, less energy is consumed and the danger of burning down is reduced. Moreover, the CCFL emits uniform and stable luminance density of light. The energy of the emitting ultraviolet light is generated by electrons falling back to their ground state due to energy gaps.

Flat panels such as liquid crystal display (LCD) panels are popular worldwide and increase the demand of CCFL because flat panel displays usually are not able to illuminate light by their own. In addition to LCD panels, scanners, fax machines, and indicators all utilize CCFL tubes. The CCFL tube is typically small, light, cost effective, have a long lifetime, and in particular, consumes little power which is important to mobile apparatuses, i.e. digital cameras and mobile phones. With the advent of technology, dimming of CCFL can easily be controlled. Additionally, the circuits used to stabilize the lighting up and turning off of CCFL can be easily integrated into a system.

Circuit design of a CCFL controller should be based on the characteristics of the CCFL tube, which are very different from those of filament bulbs. There are usually two steps need to be executed in order for CCFL tubes to emit light. First, the electrical system ignites the CCFL tube, i.e. to excite or to ionize the electrons distributed in the mercury gas. This requires very high amplitude voltage, which is usually several times the amplitude of the voltage applied in an ionization step. Next, the electrical system needs to maintain a stable alternating current to support continuous illumination. Since the CCFL tube is operated by an alternating current, the voltage passes the zero point twice in every cycle of the alternating current, including an ignition step that is necessary for every cycle. The power source for CCFL usually has a voltage around 300~400 Vrms with sinusoidal waveform, a current around 5~6 mArms, and the frequency in the range from 25 KHz to 100 KHz. The power source requires a peak over 1000 V to activate the ionization of the CCFL. A major difficulty in designing the CCFL backlight inverters is the incorporation of the very different characteristics of the ionization step and the maintenance step.

During ionization step, the ignition voltage increases to a level high enough to induce the avalanche reaction which is several times the typical forward operating voltage. The output voltage for illumination is roughly proportional to the average current. The CCFL tube exhibits a positive resistance and usually causes ambient temperature to increase. Meanwhile, the current control issue requires attention. After ionization, the CCFL tube exhibits a negative resistance if supplying a current that exceeds 1 mA. A current source is usually applied to drive a load with characteristics similar to CCFL tubes because the illumination of CCFL is primarily controlled by the average value of the applied current. The ignition voltage rises to the avalanche level until ionization is reached. Then, the voltage collapses to the operating voltage for immediate illumination.

Normally, CCFL drivers, also known as inverters or converters, utilize an electromagnetic transformer in self-resonant mode. A variety of structures are available for CCFL drivers, such as current-fed push-pull resonant inverters, current-fed Royer oscillators, half-bridge converters, and full-bridge converters.

The push-pull converter in FIG. 5A includes two transistors Q1 and Q2 alternately switches on for time periods Ton, causing the transformer core to provide an alternating voltage polarity to maximize its efficiency. The transfer function follows the basic pulse width modulation (PWM) formula and a factor of 2 is added because the two transistors alternately conduct for a portion of the switching cycle. A dead time is inserted in order to avoid a short circuit which can be the result when two transistors conduct at the same time. In a push-pull converter design, because the frequency of the ripple is twice the operating frequency, the size of the LC filters is reduced. However, the main disadvantage of the push-pull converter is that a center-tap connection transformer is required.

The half-bridge converter in FIG. 5B includes two transistors, Q1 and Q2, two capacitors, C1 and C2, and two ultra-fast diodes, D1 and D2. The diode D1 connects to the transistor Q1 in parallel, and the diode D2 connects to the transistor Q2 in parallel. One terminal of the capacitor C1 connects to one terminal of the primary winding of the transformer, and the other terminal of C1 connects to the positive power supply. One terminal of the capacitor C2 connects to the terminal of the primary winding of the transformer which also connects to capacitor C1, and the other terminal of C2 connects to the negative power supply. The input voltage is equally divided by the capacitors C1 and C2 so when either one of the transistors turns on, the transformer primarily sees Vin/2. Consequently, there is no factor 2 in the transfer function of half-bridge converter design. In a full-bridge converter design, four transistors are utilized without capacitors. Therefore, all voltages are shared equally between the transistors so that the maximum voltage can approach to VIN.

In U.S. Pat. No. 4,607,323 to Sokal et al. titled "Class E High-Frequency High-Efficiency DC/DC Power Converter", a Class E switching-mode dc/dc power converter, sometimes also known as a Class E switching-mode dc/dc power inverter, is disclosed. The entire disclosure is incorporated herein for reference. This converter operates at high frequencies, and has low power dissipation and low second-breakdown stress during turn-ons and turn-offs. In U.S. Pat. No. 5,818,709 and U.S. Pat. No. 5,834,907 to Takehara titled "Inverter Apparatus" and "Cold Cathode Tube Operating Apparatus with Piezoelectric Transformer", an inverter apparatus comprises a serial resonance circuit, a voltage feedback, and a CCFL apparatus with piezoelectric transformer, are disclosed respectively.

The stability of the current driving, and the extra components required in the prior art, i.e. the multiple transistors or the expensive piezoelectric transformer, all play important roles in the construction of a CCFL driving apparatus. It is an object of the present invention, in view of improving the efficiency and the cost effectiveness of the driver for the CCFL, to provide a driving apparatus and circuit for LCD backlight with minimum number of components and with stable supply of current such that the overall cost of LCD display apparatus can be further reduced.

SUMMARY OF THE INVENTION

The present invention involves a driving apparatus and circuit to effectively convert a direct current (DC) signal into an alternating current (AC) signal to drive a fluorescent lamp. Specifically, the invention comprises (1) a power transistor, (2) a transformer wherein a primary winding is used as a load of the power transistor and a secondary winding is used to transfer energy into the load of the driving apparatus, i.e. the CCFL tube, and (3) control means which first extracts the frequency and current of the power amplifier and then feedbacks the frequency and current to the controller in order to correct the deviation of the output waveform of the pulse width modulation circuit. The load of the power transistor, which can be the primary winding of the transformer, acts as an inductor that oscillates either with a parasitic capacitor of the power transistor, or with an external capacitor connected with the primary winding of the transformer in parallel. A resonant circuit L-C is coupled with the CCFL tube in which the inductor L can be the secondary winding for the transformer. The alternating current that goes into the secondary winding of the transformer flows first into the capacitor C, and then into the CCFL tube. The control means includes a pulse width modulation (PWM) circuit, a current controller, a periodic waveform generator, and a frequency modification circuit.

In one embodiment of the invention, the periodic waveform generator sends a periodic waveform into the PWM circuit and receives the control signal from the frequency modification circuit. Normally, a periodic waveform is created by charging a large capacitor with specified current source. The control signal from the frequency modification circuit modifies the charging speed. Moreover, there is a buffer circuit that couples with the PWM circuit to drive the power switch, i.e. applying voltages on the gate of the power transistor.

The frequency modification circuit detects the frequency generated by the resonant circuit. The resonant circuit is composed of a primary winding and a capacitor which can either be an external capacitor, or a parasitic capacitor of the power transistor. After comparing the detected frequency of the resonant circuit with an original frequency, the result is sent to the periodic waveform generator for real time frequency adjustment to improve the efficiency of the driver apparatus.

Several passive components like resistors and diodes are included in the driving apparatus to create specified voltage references, or to protect the circuits from damage under severe conditions. Additional capacitors are included in the driving apparatus for adapting the charge and/or discharge time, or for stabilizing the reference voltages. Furthermore, few transistors are employed in order to mirror current flow or to play the role of switches. Many modifications and adjustments of the components can be made and they will still fall within the spirit and scope of the present invention.

BRIEF DESCRIPTION OF THE DRAWINGS

Various objects and advantages of the present invention will be more readily understood from the following detailed description when read in conjunction with the appended drawing, in which.

DESCRIPTION OF EMBODIMENTS OF THE INVENTION

Figure 1:
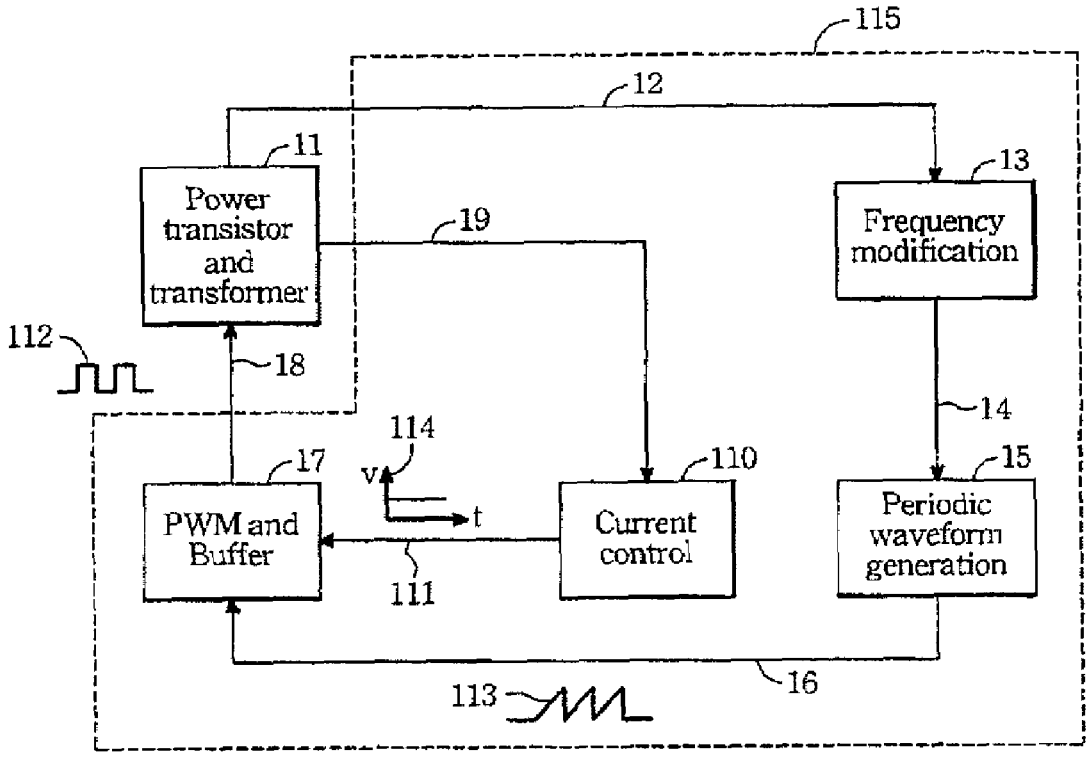
FIG. 1 is a functional circuit diagram of the operations of the driving apparatus of CCFL.

FIG. 1 illustrates a driving apparatus according to one embodiment of the present invention. The driving apparatus comprises a power circuit 11 and a control circuit 115. The power circuit 11 is coupled with the fluorescent lamp. In order to effectively control the power circuit 11, a control signal 18 is provided by the control circuit 115. Moreover, the control circuit 115 extracts at least one signal as a feedback reference for further adaptation.

The power circuit 11 comprises a power transistor and a transformer. The control circuit 115 includes a PWM circuit 17 containing a pulse width modulation (PWM) circuit with an optional buffer, a current controller 110, a frequency modification circuit 13, and a periodic waveform generator 15. The power circuit 11 acts as a DC-to-AC converter while the control circuit 115 stabilizes the operation of the power circuit 11. Moreover, the periodic waveform generator 15 can be in any shape of periodic waveform where the purpose is to provide a waveform that contains frequency information to the PWM circuit 17. The triangular waveform generation is described here as one embodiment of the present invention.

The power circuit 11 receives a PWM signal 18 outputted from the PWM circuit 17 for controlling the power transistor. The PWM circuit 17 receives a triangular waveform signal 16 from the periodic waveform generator 15. The PWM circuit 17 also receives a signal 111 carrying a reference voltage from the current controller 110. With the reference voltage and the triangular waveform signal 16, the PWM circuit 17 generates the PWM signal 18 to control the switching of the power transistor in the power circuit 11. The frequency of the triangular waveform signal 16 is not always fixed but changes according to an input signal 14 of the periodic waveform generator 15. The frequency modification circuit 13 detects the resonant frequency by an output signal 12 from the power circuit 11 and then sends the control signal 14 to the periodic waveform generator 15, whereby the frequency of the triangular waveform signal 16 is adjusted for compensation of the frequency shifting resulted from the deviation of manufacturing processes or environmental factors, such as temperature and humidity changes. Similarly, the power circuit 11 outputs a signal 19, which contains the information about the current passing through the CCFL tube, into the current controller 110 to prevent the current from exceeding the current limitation of the tube or falling under the minimum current to illuminate the tube. Furthermore, the signal 12 and the signal 19 are the feedback signals in the driving apparatus which provide a real time feedback mechanism to protect the tube from heavy damages.

Alternatively, the frequency modification circuit 13 may extract the frequency of the PWM signal 18 as a reference frequency for controlling the waveform generation of the periodic waveform generator 15. Moreover, the signal 111 from the current controller 110 is not limited to a reference voltage 114. The signal 111 may be a signal containing the current information. Digital information may also be included in the signal 111 to transmit the status of current passing through the CCFL tube. Here, according to the illustration of the FIG. 1, the necessary circuit elements that couple with the CCFL tube are not shown but can be taken as being included in the power circuit 11 such that that the signal 19 can be drawn from the power circuit 11 for further descriptions.

Figure 2:
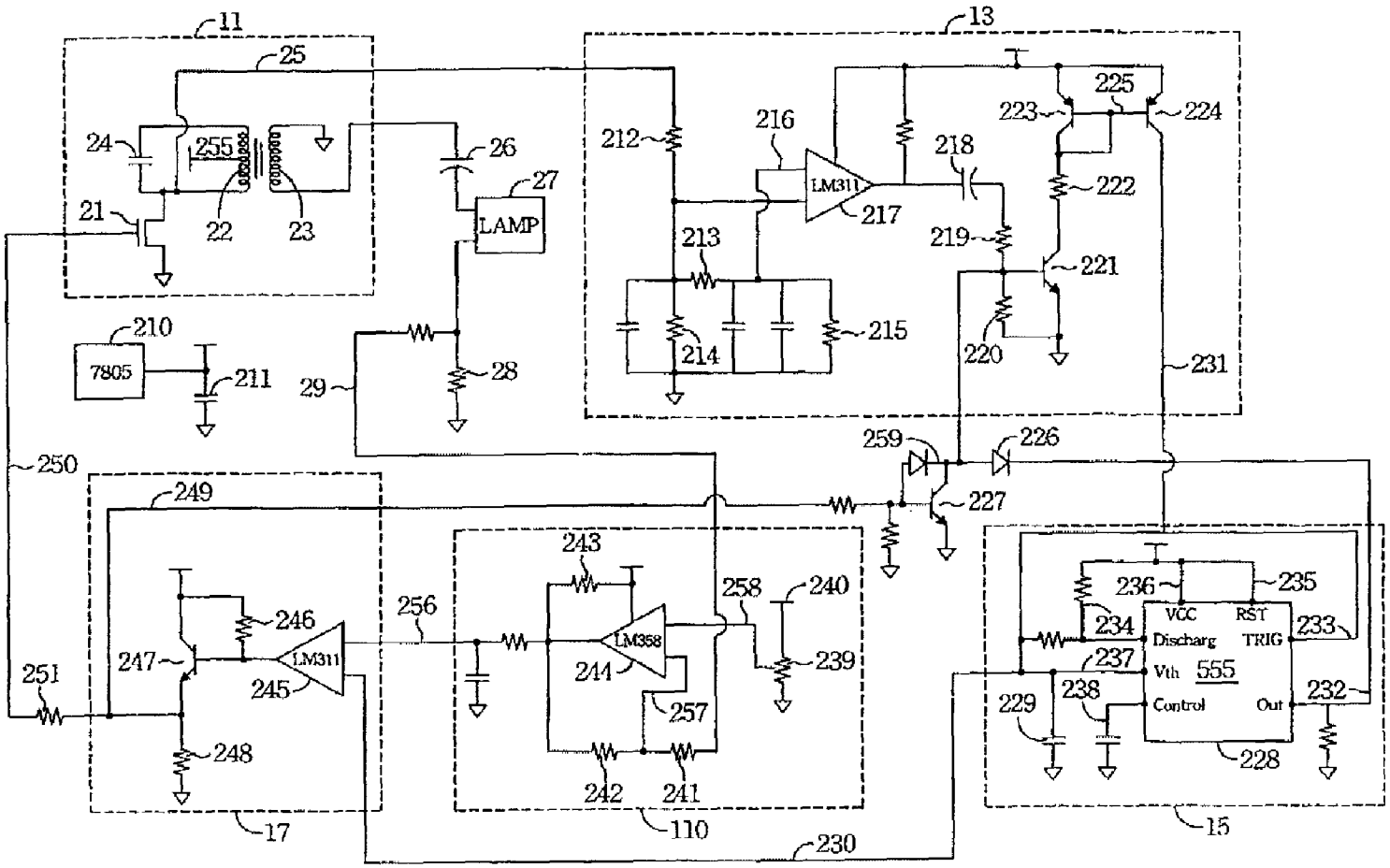
FIG. 2 is a schematic circuit diagram showing the topology of the driving system of the invention.

FIG. 2 shows an embodiment of the present invention in a detailed schematic view. In this figure, the numeration is the same as the numeration indicated in FIG. 1, with additional circuits included for applications. The dotted boxes with annotated numbers 11, 13, 15, 17, and 110 in FIG. 2 refer to the power circuit 11, frequency modification circuit 13, periodic waveform generator 15, the PWM circuit 17, and current controller 110 in FIG. 1, respectively.

A circuit 210 shown here can be a popular regulator integrated circuit (IC) which is known by those skilled in the art as an IC 7805. Normally, a power and a capacitor 211 is connected to the IC 7805 210 to construct a power source for the driving apparatus. The general operation between the circuits and the additional components of the driver apparatus can be understood by referring to FIG. 1. The details in the circuit design implementing the electrical operations are illustrated in FIG. 2.

The power circuit 11 for directly driving a CCFL tube 27 comprises a power transistor 21 wherein the power transistor 21 is indicated here as a power MOS, a transformer containing a primary winding 22 and a secondary winding 23 wherein the primary winding 22 is used both as a load of the power transistor 21 and also as a necessary resonant element by connecting a power source 255 to the primary winding 22. The primary winding 22 not only resonates with the parasitic capacitor of the power transistor 21, but also resonates with an external capacitor 24 depending on the requirement of the oscillation. After the primary winding 22 begins to resonate with either the parasitic capacitor or the external capacitor 24, an amount of energy is stored in the primary winding 22. Through the transformer composed of the primary winding 22 and secondary winding 23, the energy stored in the primary winding 22 can be transferred to the secondary winding 23 according to the turn's ratio of the primary winding 22 and the secondary winding 23. Therefore, an alternating current occurred in the primary winding 22 can then be transferred into the secondary winding 23. One terminal of the secondary winding 23 is connected to ground and the other terminal is connected to a capacitor 26 which passes only alternating signals to the CCFL tube 27 and stops any direct signals. One terminal of the CCFL tube 27 is connected to a resistor 28 and the other terminal is connected to ground. Any current passing through the CCFL tube 27 also passes through the resistor 28. The current information can then be transmitted to the current controller 110 as a reference for the current status of the CCFL tube 27. Moreover, the power transistor 21 is controlled by an electrical signal 250 coupling with the gate of the power transistor 21. When the electrical signal 250 rises to high, the power transistor 21 turns on, and current passes through the power transistor 21 from the drain to the source connecting to ground if the transistor is N type. Transistors usually are divided into an N type, i.e. NMOS or N type BJT and a P type, i.e. PMOS or P type BJT. Many combinations of circuit configurations, for example by varying the types of the transistor 21, the power supplies, and the ground connections of the transformer, can be easily made by those skilled in the art.

The PWM circuit 17 comprises of an operational amplifier 245, i.e. LM311, a transistor 247, a resistor 246, and a second resistor 248. The operational amplifier 245 receives a reference voltage on a net 256, which is a voltage outputted from the current controller 110. The operational amplifier 245 also receives a signal with triangular waveform from a net 230 from the periodic waveform generator 15. A triangular waveform is a periodic and a rising voltage that is proportional to time. Thus, the operational amplifier 245 outputs a voltage level, i.e. high level, and another voltage level, i.e. low level, until the rising voltage of the triangular waveform on the net 230 reaches the reference voltage on the net 256. Moreover, periodic high and low voltage levels, such as periodic square waveforms, are outputted from the operational amplifier 245. After the periodic square waveform is generated from the operational amplifier 245, the periodic square waveform is passed to the power transistor 21 via a buffer. The buffer comprises a resistor 246, a transistor 247, and another resistor 248, and is configured as a source follower known as those skilled in the art. The resistor 246 acts as a feedback loop and the resistor 248 acts as a bias resistor.

The current controller 110 comprises an operational amplifier 244 (i.e., LM358 known as a low power dual operational amplifier,) a resistor 239 connected to a voltage supplier 240, and several resistors 241, 242, 243, forming the voltage divider according to the requirement of the voltage level needed. The operational amplifier 244 receives a reference voltage level from a net 258 and a voltage level from a net 257. The voltage level from a net 257 varies as the current through a net 29 changes. Noted that the net 257 also equals to the current passing through the CCFL tube 27. After comparison, the amplifier 244 outputs a voltage level on a net 256 as a reference voltage level to the PWM circuit 17. A resistor 242 acts as a feedback loop for the operational amplifier 244.

The frequency modification circuit 13 includes an operational comparator 217 (i.e. LM311 known as a voltage comparator,) and a current mirror. A net 25 extracts a resonant electrical waveform from the transformer and passes it to the operational comparator 217. The operational comparator 217 compares the electrical signal from the net 25 to a reference voltage on a net 216, and outputs a periodic alternating waveform through a capacitor 218 into a transistor 221. The transistor 221 is controlled by an output of the comparator 217 and/or a signal from a net 259. Net 259 is the drain of a transistor 227 controlled by a signal on a net 249 from the PWM circuit 17. A transistor 221 controls the current mirror that includes a transistor 223, a transistor 224, and a resistor 222. When the transistor 221 is turned off, no current is mirrored into a net 231. When the transistor 221 is turned on, current flows into the net 231 and charges the capacitor 229 in the periodic waveform generator 15.

The periodic waveform generator 15 can be constructed with a timer IC 228, i.e. oscillator IC 555. The current on the net 231 from the frequency modification circuit 13 charges the capacitor 229 and forms a rising triangular voltage. The rising voltage continues to charge up until a voltage level on a net 237 reaches a threshold voltage and triggers a new oscillation cycle. The configuration of the waveform generation can be made into other combinations known to those skilled in the art. Thus, the triangular waveform generation is not limited to the circuits disclosed herein because other combinations can be implemented without departing from the scope of the present invention. The current on the net 231 is adjusted according to the status of the resonant circuit that couples with the power transistor. Therefore, the rising time of the triangular waveform generated by the timer IC 228 can be easily controlled in real time such that a frequency-modified triangular waveform is sent to the PWM circuit 17 via a net 230.

Figure 3:
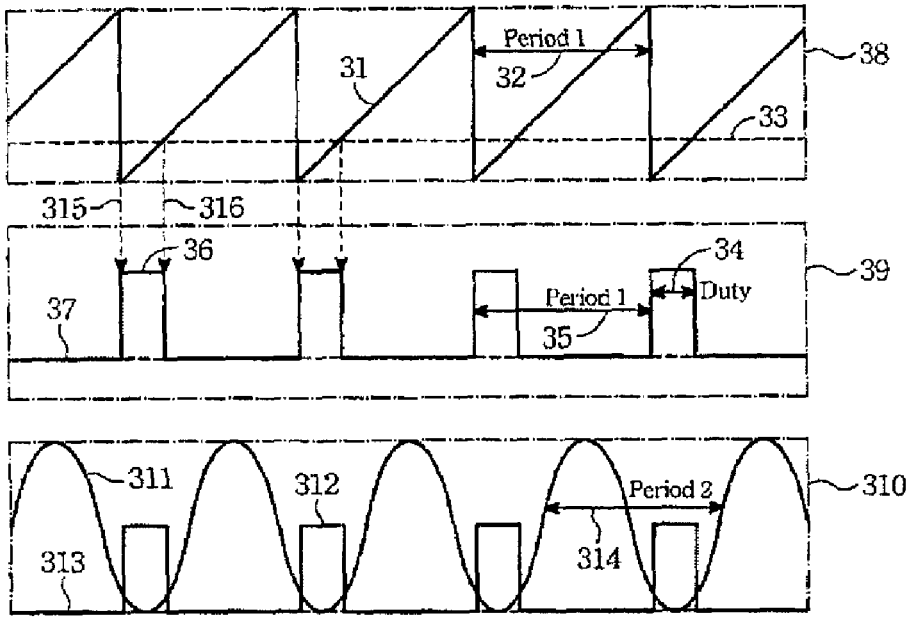
FIG. 3 shows the waveform of the power transistor without auto track of the frequency according to the prior art.

FIG. 3 describes the relationship among the generated triangular waveform 113, the driving waveform 112 on the gate of the power transistor 21, and the resonant oscillation waveform 311 of the primary winding 22, which were all referenced in FIG. 2. FIG. 3 illustrates an example of CCFL driving apparatus without the frequency and current feedback mechanism suggested by the present invention. A first diagram 38 in the FIG. 3 includes a triangular waveform 31 and a reference voltage 33 generated by the current controller 110. A period 32 of the triangular waveform 31 indicates the frequency of the periodic waveform. The PWM circuit 17 compares the voltage of the triangular waveform 31 and the reference voltage 33 and then outputs high 36 if the voltage of the triangular waveform 31 is lower than the reference voltage 33. Similarly, the circuit outputs low 37 if the voltage of the triangular waveform 31 is higher than the reference voltage 33. The diagram 39 shows the driving waveform generated by the PWM circuit 17. Since the triangular waveform 31 is periodic, the driving waveform is also periodic. A period 35 is the same as the period 32 and a duty 34 represents the time when the triangular waveform 31 is lower than the reference voltage 33. More energy is stored in the primary winding 22 when the duty 34 is long because more current passes through the primary winding 22. The diagram 310 represents the relationship between the driving waveform and the resonant oscillation waveform 311 wherein the period 314 indicates frequency information. If the driving waveform is high 312, the current passes through the power transistor 21 and stores energy in the primary winding 22. When the driving waveform goes low 313, the primary winding 22 releases energy to the secondary winding 23. The energy passes through the CCFL tube and further illuminates the tube. Typically, the operation frequency 32 and the resonant frequency 314 should be synchronized so that ideal efficiency can be achieved. The irregularities of circuit components, the changes in air temperature, and the deterioration of components as a result of usage and time, are all factors that affect the efficiency of the circuit.

Figure 4:
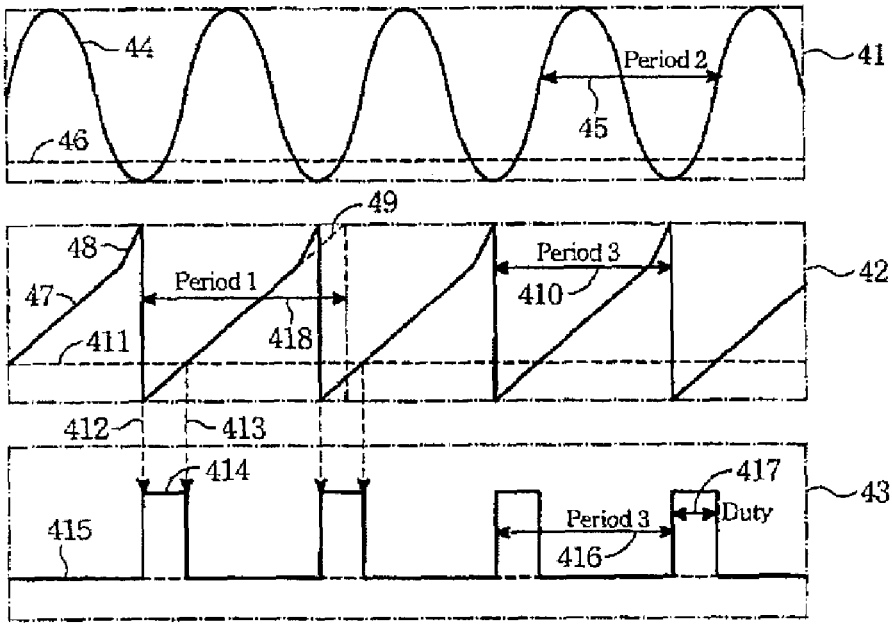
FIG. 4 shows the waveform of the power transistor with auto track of the frequency according to the present invention.
Figure 5A:
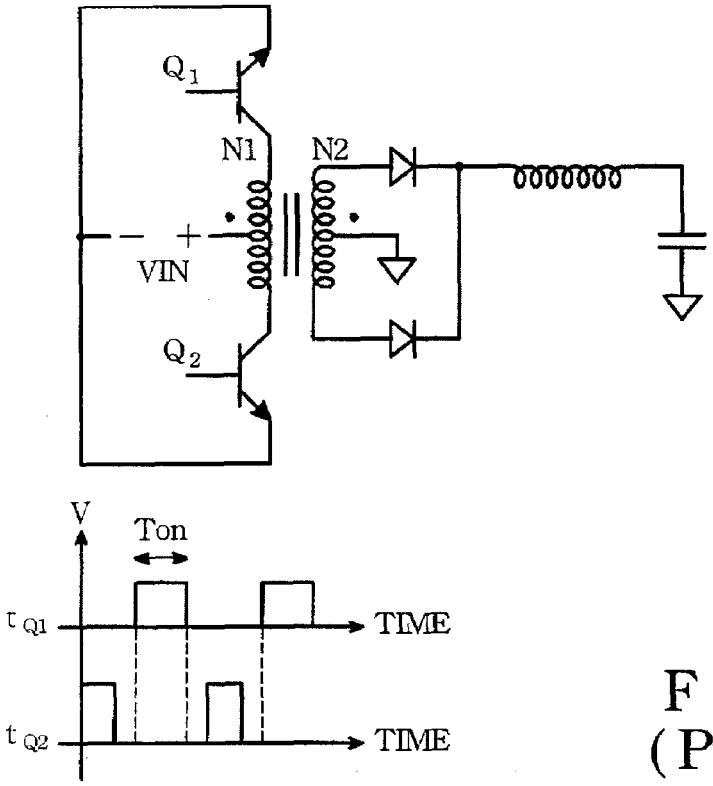
FIG. 5A (Prior Art)
FIG. 5A illustrates a push-pull bridge converter in the prior art.
Figure 5B:
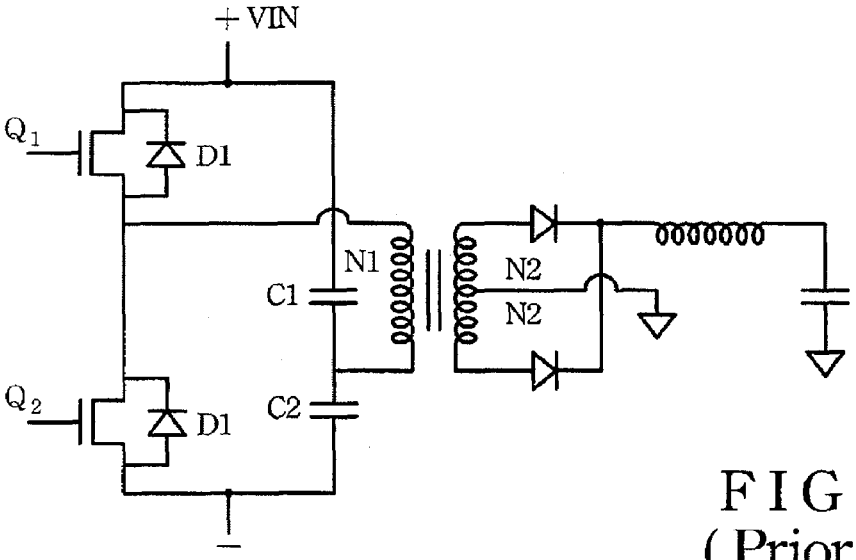
FIG. 5B (Prior Art)
FIG. 5B is a diagram illustrating a half bridge converter in the prior art.

FIG. 4 illustrates the improved waveforms in one embodiment of the present invention. Diagram 41 includes a resonant oscillation waveform 44 whose period is a period 45, and a low reference voltage 46 use to detect the events when the oscillation waveform 44 reaches zero level. All the information in FIG. 4 provides the frequency information of the resonant oscillation of the primary winding 22 referenced in FIG. 2. Diagram 42 illustrates an adjusted triangular waveform 47 whose adjusted period is a period 410 and whose original period is a period 418. Using the frequency information of the resonant oscillation of the primary winding 22 from Diagram 41, the triangular waveform 47 can be adjusted. A waveform 49 represents a mismatch between the triangular waveform 47 and the oscillation waveform 44 and causes an inappropriate driving waveform in the diagram 43. Applying the modification proposed by the present invention, the waveform 49 is adjusted to a waveform 48 and a matching driving waveform is obtained. The circuit according to the present invention increases the charging of the capacitor 229 in FIG. 2 whenever a frequency shift event is detected. A high level 414 shows a duration when the voltage of the triangular waveform is lower than the reference voltage 411 from the current controller 110. On the contrary, a low level 415 shows a duration when the voltage of the triangular waveform is higher than the reference voltage 411 form the current controller 110. A duty 417 indicates that the modified duty of the driving waveform in the diagram 43 of the period 416 matches with the period 45. With matching frequencies between the driving waveform and the resonant oscillation, a driving apparatus with better efficiency can be acquired.

Moreover, another embodiment of the present invention comprises a single power transistor configuration of power amplifier and a frequency automatic tracking mechanism for achieving the stability and efficiency of the whole CCFL driving apparatus and circuit. The oscillation 44 represents the output waveform from non-ideal electronic components, i.e. the power transistor and transformer. Normally, the resonant properties of these non-ideal electronic components are not uniform due to manufacturing variations. Additionally, environmental factors such as temperature, humidity, and etc. also affect the performance of the resonance. Therefore, it is an object of the present invention to compensate these non-ideal and environmental factors by including a frequency automatic tracking mechanism. With an automatic frequency tracking mechanism, the generated triangular waveform 42, which equals the frequency of the driving waveform 43, is corrected according to the frequency extracted from the resonant components so that the frequency of the driving waveform 43 can match the frequency of the resonant waveform 41 to achieve higher driving efficiency and better power saving. If the frequency of driving waveform 43 is synchronized with the frequency of the resonant waveform, the power transistor will reset the resonant oscillation while the voltage of the oscillation 44 reaches below the low reference voltage 46. Thus, the resonant components exhibit their optimal characteristics without the deviation caused by variations and defects in the driving circuits.

It is understood that the drawings show an exemplification given only as a practical demonstration of the invention. The drawings may vary in forms and dispositions without exceeding the scope of the idea on which the present invention is based. These embodiments are not meant as limitations of the invention, but merely exemplary descriptions of the invention with regard to certain specific embodiments. Indeed, different adaptations may be apparent to those skilled in the art without departing from the scope of the annexed claims.

What is claimed is:

1. A lamp driving apparatus to illuminate a lamp comprising:

a power circuit that provides alternating current to said lamp;

a control circuit that extracts current and frequency information from the power circuit; and a control signal that controls the power circuit;

wherein said power circuit comprises:

a power transistor for passing current, and a transformer comprising a primary winding and a secondary winding, wherein said primary winding is used as a load for said power transistor and said secondary winding is used to transfer energy to the lamp; and wherein said control circuit comprises:

a current controller that extracts the current of a power amplifier and couples with a PWM (pulse width modulation) circuit, and a periodic waveform generator that couples with said PWM circuit and a frequency modification circuit, wherein said frequency modification circuit extracts the frequency information from said power amplifier, and said power amplifier further comprising said power transistor and said primary winding used as a load.

2. The lamp driving apparatus according to claim 1, wherein said lamp driving apparatus is used for a flat panel display device.

3. The lamp driving apparatus according to claim 1, wherein said control circuit comprises a frequency modification circuit that extracts frequency information from said power circuit and outputs a second control signal.

4. The lamp driving apparatus according to claim 1, wherein said control circuit extracts the frequency and current of said power amplifier and provides a feedback to correct the deviation of an output waveform from said PWM circuit.

5. The lamp driving apparatus according to claim 1, wherein said power transistor comprises a MOS transistor or a BJT transistor.

6. The lamp driving apparatus according to claim 1, further comprising an external capacitor connected to said primary winding in parallel.

7. The lamp driving apparatus according to claim 1, wherein said lamp is a cold cathode fluorescent (CCFL) lamp.

8. The lamp driving apparatus according to claim 1, further comprising a buffer that couples with said PWM circuit to amplify signals outputted from said PWM circuit, to control the on or off of said power transistor, and to increase the driving ability of said power transistor.

9. The lamp driving apparatus according to claim 1, wherein said current controller detects a current that passes through the lamp and sends a reference signal to said PWM circuit such that said lamp operates stably.

10. The lamp driving apparatus according to claim 1, wherein said frequency modification circuit extracts a resonant status from said power amplifier and sends a second control signal to said periodic waveform generator to obtain a matching frequency between the resonant frequency of said power amplifier and that of a periodic waveform from said periodic waveform generator.

11. The lamp driving apparatus according to claim 1, wherein said frequency modification circuit extracts a resonant status from said power amplifier, compares second control signal into said periodic waveform generator to obtain a matching frequency between the resonant frequency of said power amplifier and that of a periodic waveform from said periodic waveform generator.

12. The lamp driving apparatus according to claim 1, wherein said frequency modification circuit extracts a resonant status from said transformer and sends a second control signal to said periodic waveform generator to obtain a matching frequency between the resonant frequency of said transformer and that of a periodic waveform from said periodic waveform generator.

13. The lamp driving apparatus according to claim 1, wherein said current controller comprises an operational amplifier and a reference voltage.

14. The lamp driving apparatus according to claim 1, wherein said frequency modification circuit comprises an operational amplifier and a current mirror passing current into said periodic waveform generator.

15. The lamp driving apparatus according to claim 1, wherein said periodic waveform generator comprises a timer IC for charging or discharging a capacitor.

16. The lamp driving apparatus according to claim 1, wherein said periodic waveform generator receives a second control signal from said frequency modification circuit modifying the charge or discharge speed, and outputs a periodic waveform into said PWM circuit as a frequency reference.

17. The lamp driving apparatus according to claim 16, wherein said periodic waveform is a triangular waveform.

18. The lamp driving apparatus according to claim 1, wherein said frequency modification circuit extracts a resonant status from said transformer, compares said resonant status to an original frequency outputted from said PWM circuit, and sends a second control signal into said periodic waveform generator to obtain a matching frequency between the resonant frequency of said transformer and that of a periodic waveform from said periodic waveform generator.

19. The lamp driving apparatus according to claim 8, wherein said buffer comprises a transistor and two resistors configured as a source follower.

* * * * *